US007114505B2

(12) United States Patent
Bauer et al.

(10) Patent No.: US 7,114,505 B2
(45) Date of Patent: Oct. 3, 2006

(54) MAKE-UP DEVICE

(75) Inventors: Reinhard Bauer, Rosstal (DE); Herbert Brendel, Nürnberg (DE); Thomas Heidenreiter, Kalehreuth (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 86 days.

(21) Appl. No.: 10/513,868

(22) PCT Filed: Sep. 25, 2003

(86) PCT No.: PCT/EP03/10671

§ 371 (c)(1),
(2), (4) Date: Nov. 4, 2004

(87) PCT Pub. No.: WO2004/045335

PCT Pub. Date: Jun. 3, 2004

(65) Prior Publication Data

US 2005/0199256 A1 Sep. 15, 2005

(30) Foreign Application Priority Data

Nov. 18, 2002 (DE) ..... 202 17 821 U

(51) Int. Cl.
*A45D 40/26* (2006.01)

(52) U.S. Cl. ..... 132/218; 401/120

(58) Field of Classification Search ..... 132/218; 401/123, 126, 129, 120
See application file for complete search history.

(56) References Cited

U.S. PATENT DOCUMENTS

| | | | | |
|---|---|---|---|---|
| 4,548,524 | A | 10/1985 | Seager | |
| 4,886,387 | A * | 12/1989 | Goldberg et al. | 401/122 |
| 4,929,108 | A * | 5/1990 | Gueret | 401/126 |
| 5,324,128 | A | 6/1994 | Gueret | |
| 5,492,426 | A | 2/1996 | Gueret | |
| 5,636,931 | A | 6/1997 | Gueret | |
| 6,082,918 | A * | 7/2000 | Gueret | 401/126 |
| 6,142,692 | A | 11/2000 | Garcia | |
| 6,305,863 | B1 | 10/2001 | Gueret | |
| 2006/0051154 | A1 * | 3/2006 | Bauer et al. | 401/123 |

FOREIGN PATENT DOCUMENTS

| | | |
|---|---|---|
| EP | 1 419 711 | 5/2004 |
| FR | 2 753 060 | 9/1996 |

* cited by examiner

*Primary Examiner*—Cris L. Rodriguez
*Assistant Examiner*—Rachel Running
(74) *Attorney, Agent, or Firm*—Bachman & LaPointe, P.C.

(57) ABSTRACT

A makeup device comprising a first region for storing a cosmetic product and a second region for loading an applicator with the cosmetic product, wherein the second region is separated from the first region.

18 Claims, 1 Drawing Sheet

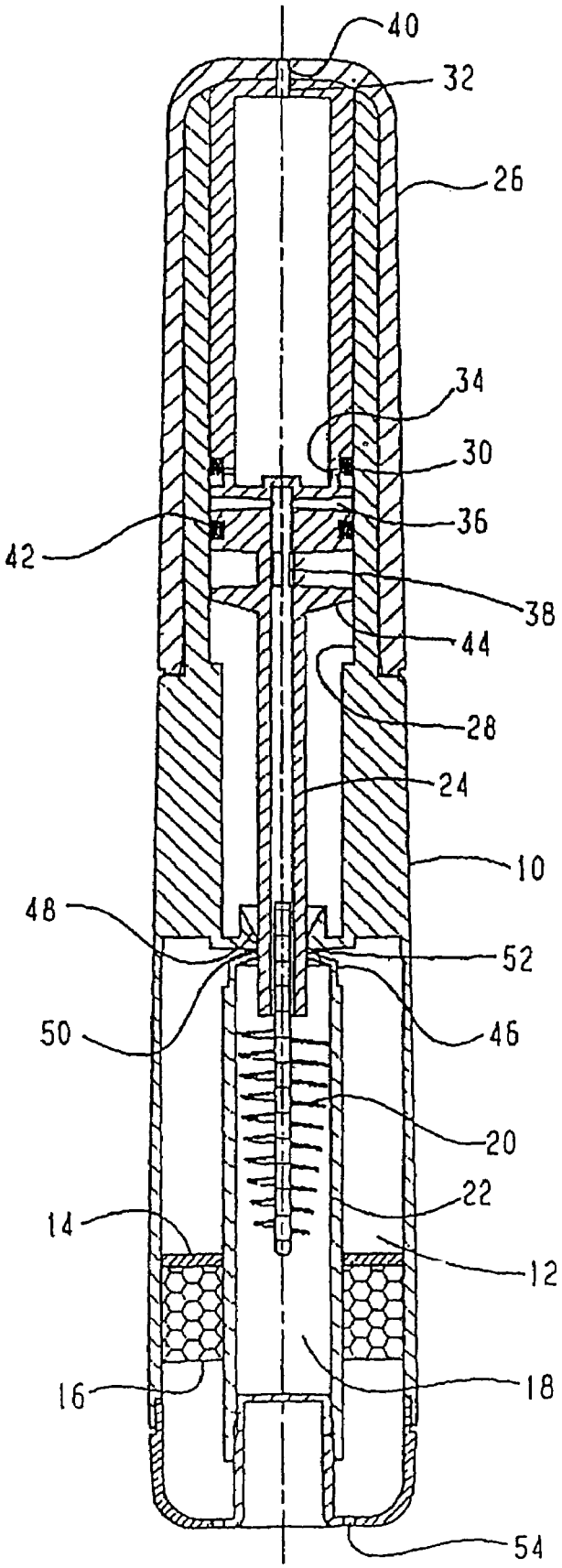
40
32
26
34
30
36
42
38
44
28
24
10
48
52
50
46
20
22
14
12
16
18
54

MAKE-UP DEVICE

BACKGROUND OF THE INVENTION

The invention concerns a makeup device comprising a first region for storing a cosmetic product. In that respect the invention relates in particular to a makeup device which is used in conjunction with eyelash makeup or mascara. The invention however is not limited to that use.

Makeup devices of the above-indicated kind are known. These conventionally involve what are known as dip systems in which an application device or applicator is dipped into the first region to load the applicator with the cosmetic product. The conventional makeup devices need improvement:

Due to the applicator being dipped into the cosmetic product the cosmetic product can be contaminated, in particular with germs, as a result of which it can become unusable. In order that the applicator can dip into the first region at all, a comparatively large opening is required, and that involves a comparatively large surface area for air to act thereon, in regard to the stored cosmetic product. That gives rise to the risk of the stored cosmetic product drying out or ageing. In addition, in the case of viscous cosmetic products the applicator, after being dipped thereinto, leaves behind a crater-like depression which entails an increase in the surface area open to attack by the air. In addition, in view of the crater-like depression, a lady user could be induced to "help things along" for example with water because she had the impression that the cosmetic product had dried out, thereby involving serious risks of contamination. Added to that is the fact that, when loading cosmetic product for example onto an applicator in brush form having a stem, the cosmetic product can also pass onto the stem, whereby the stem becomes increasingly fouled. In addition precise metering is not possible. It is also to be observed that wiper devices which are conventionally provided are admittedly operative radially but not axially, and for that reason lumps of the cosmetic product remain on the applicator, and they result in overapplication and smudging when applying the makeup. If those lumps are wiped off for example on a paper tissue, then cosmetic product is wasted. Finally a problem is also to be found in the fact that dried-out crumbly residues which are to be found under some circumstances on the applicator are mixed into the stored cosmetic product when the applicator is dipped, or dipped again, into the first region.

The object of the present invention is to improve the makeup device of the kind set forth in the opening part of this specification in such a way that the above-described disadvantages and problems are eliminated.

SUMMARY OF THE INVENTION

According to the invention the specified object is attained by a second region for loading an applicator with the cosmetic product, wherein the second region is separated from the first region.

In other words, in accordance with the invention, the operation of loading an applicator does not take place within the storage region for the cosmetic product. That eliminates any "retroaction". In particular the problem of the stored cosmetic product being contaminated with germs no longer arises. In addition there does not have to be any access, corresponding to the size of the applicator, to the cosmetic product storage means (first region), so that the risk of the cosmetic product drying out or ageing because of excessively large surface areas affording access to the air no longer occurs. There is also no risk of a stem of an applicator being unintentionally smeared with the cosmetic product. Finally there is no possibility of crumbly residues passing into the first region.

In accordance with a particularly preferred embodiment of the invention there is provided at least one feed passage for feeding cosmetic product from the first region to the second region.

In a further preferred feature the makeup device according to the invention has a conveyor means for conveying cosmetic product from the first region into the second region.

In that respect the conveyor means can be in principle of any desired configuration. In accordance with a particularly preferred embodiment of the invention however it is adapted to reduce the pressure in the second region relative to the pressure in the first region. Particularly when the above-mentioned feed passage is provided, cosmetic product is conveyed from the first region into the second region upon actuation of the conveyor means.

In a further preferred feature the conveyor means is coupled to an applicator for the cosmetic product. That provides that the conveyor means is actuated when the applicator is actuated, for example when the applicator is removed from a rest position.

Preferably in accordance with the invention the conveyor means comprises a piston-cylinder unit.

In that case in a further preferred feature the piston is disposed in a handle portion of an applicator.

In order to be able to appropriately set the pressure conditions in each respective situation, in accordance with a particularly preferred embodiment of the invention the makeup device is provided with a controllable valve.

In that respect, the valve can be open in a first operating condition of the conveyor means, whereas it is closed in a second operating condition of the conveyor means.

In a preferred feature according to the invention the valve has a ring seal.

In that respect, a particularly preferred embodiment of the invention provides that the ring seal is displaceable and opens a vent opening in a first operating condition while it closes the vent opening in a second operating condition.

Additionally or alternatively in accordance with the invention the operating condition of the valve is also pressure-dependent.

In that respect it can be provided for example that the valve opens when a threshold pressure is exceeded and closes when the pressure falls below the threshold pressure. In other words the valve in accordance with the invention is preferably bistable.

In accordance with a particularly preferred embodiment of the invention the makeup device has a receiving region, which is separated from the first region, for an applicator in a rest position.

In that respect it can further be provided that the first region (storage region) surrounds the receiving region in the manner of a tubular casing.

According to the invention preferably in that case the second region adjoins the receiving region in such a way that the applicator passes the second region (loading region) when it is removed from the receiving region.

Particularly when the conveyor means is designed in the manner of a piston-cylinder unit and is coupled to the applicator, in this configuration of the invention the applicator is loaded (automatically) with the cosmetic product upon being removed from the receiving region.

In accordance with a preferred embodiment of the invention a drag piston serves for sealing off the first region with respect to the environment.

In that respect in a further preferred feature the drag piston has a closure mass.

In a further preferred feature the drag piston has an abutment disk. That thus provides a metering stop.

In accordance with a further preferred feature the invention provides not only the makeup device in accordance with the foregoing configurations but also such a makeup device in combination with an applicator for the cosmetic product.

In addition the invention also relates to the applicator device for a makeup device in accordance with the foregoing configurations.

In that respect in accordance with the invention in a preferred feature the applicator is coupled at least to a part of a conveyor means for the cosmetic product.

In a further preferred feature the applicator is coupled to a piston of a piston-cylinder arrangement serving as a conveyor means.

Finally the applicator according to the invention has a handle portion within which the piston is arranged. With this design configuration the piston which is found to be aesthetically unattractive is not visible.

It is expressly pointed out that the invention provides not only a makeup device of the above-described nature and an applicator of the above-described nature separately in each case, but also a combination of those two components with each other.

BRIEF DESCRIPTION OF THE DRAWINGS

The invention is described in greater detail hereinafter by means of a preferred embodiment by way of example with reference to the accompanying drawing in which:

The single FIGURE is a diagrammatic sectional view of a preferred embodiment of the makeup device according to the invention in combination with a particularly preferred embodiment of the applicator according to the invention.

DETAILED DESCRIPTION

The makeup device illustrated in the drawing is denoted by reference numeral 10. It is of a circular-cylindrical contour. A storage means 12 serves for the storage of a cosmetic product, for example eyelash makeup or mascara. The storage means 12 is closed at the bottom in the drawing by an abutment disk 14 in the form of a circular ring. Disposed on the opposite side of the abutment disk 14 is a closure mass 16 which seals off the storage means 12 in relation to the environment in order to prevent the cosmetic product from drying out. The makeup device 10 further has a receiving space 18 for a mascara brush 20 which is only diagrammatically shown in the drawing and which serves as an applicator. The receiving space 18 is separated from the storage means 12 by a wall 22 surrounding the receiving space. It will be appreciated that it is also possible to use any other applicators instead of the mascara brush 20, such as for example plastic pressings and metal coils.

The mascara brush 20 is held by a holder 24 which in turn is fixed to a handle portion 26, for example by gluing. A sealing ring 30 is disposed between the holder 24 and an inside wall 28 of the makeup device 10.

The holder 24 has vent openings 32, 34, 36 and 38. The handle portion 26 has a vent opening 40. The function of those vent openings is described hereinafter.

In the illustrated embodiment an O-ring 42 serves as a wiper. The wiper however can also be of a different configuration, for example in the form of a sealing lip. A conical projection 44 on the holder 24 serves for centering purposes.

The end portion 46 of the wall 22 which is upward in the drawing, and an adjacent projection 48 serve as wipers. Formed between the wipers 46 and 48 is an annular gap which serves as a feed passage 50. In that arrangement the annular feed passage 50 surrounds the loading region 52. Instead of the annular feed passage 50 it is also possible to provide one or more "windows" in a wall which extends around the loading region in an annular configuration.

A vent opening 54 is provided for venting the space behind the elements 14 and 18 which serve as a drag piston.

The function of the makeup device 10 in conjunction with the mascara brush 20 and the holder 24 is discussed hereinafter:

Let it be assumed that there is mascara or eyelash makeup in the storage means 12. When now the handle portion 26 is removed from the makeup device 10 the holder 24 moves upwardly in the drawing relative to the makeup device 10. As a consequence the sealing ring 30 is displaced in such a way that it closes the vent opening 34. Upon further movement of the holder 24 within the makeup device 10 therefore the holder 24 acts like a piston within the makeup device 10 which serves as a cylinder, whereby a reduced pressure is produced. The result of that reduced pressure is that the mascara 12 is conveyed into the loading space 52 by way of the annular gap 50 serving as a feed passage. The mascara brush 20 gradually passes that loading region 52, whereby the mascara brush 20 is loaded with mascara.

Loading of the mascara brush in the loading space 52 is highly regular. In particular it is independent of the filling level. A screwthread can be provided between the handle portion 26 and the makeup device 10 in order to make the loading operation more uniform. More specifically that provides that the above-mentioned "withdrawal" of the handle portion 26 from the makeup device 10 is rendered more uniform in its progress.

After the makeup operation, that is to say after use of the mascara brush 20 or in between times when the mascara brush is all used up, the mascara brush 20 is introduced into the receiving space 18 again. In that case it passes in particular the wiper 48 which removes any mascara which has dried solid on the brush. Any mascara residues which may be present at the inside wall 28 of the makeup device 10 are removed by the O-ring 42.

Introduction of the mascara brush 20 into the receiving space 18 also involves introduction of the holder 24 with the sealing ring 30. In that case the sealing ring 30 is displaced upwardly in the drawing with respect to the holder 24, whereby the vent opening 34 is opened. Now, the space delimited by the inside wall 28 is communicated with the ambient atmosphere by way of the vent openings 38, 36, 34, 32 and 40 so that no increased pressure occurs.

With increasing consumption of the mascara in the storage means 12 the abutment disk 14 together with the closure mass 16 moves upwardly in the drawing. As soon as the abutment disk 14 comes to bear against the upper boundary of the storage means 12 the makeup device 10 is all used up. That is evidently only the case when the mascara in the storage means 12 is approximately 100% consumed.

Instead of the ring seal 30 and the vent openings 32, 34, 36, 38 and 40 it is also possible to implement a different valve solution. For that purpose for example it is possible to provide at the bottom of the receiving space 18 a valve which is biased elastically in the closing direction and which opens at a given pressure within the receiving space. In that case the opening pressure is 0.02 bar or lower.

The features disclosed in the foregoing description, the claims and the drawing can be essential for implementation of the invention in the various embodiments thereof both individually and also in any combinations.

The invention claimed is:

1. A makeup device (10) comprising a first region (12) for storing a cosmetic product, and a second region (52) for loading an applicator (20) with the cosmetic product, wherein the second region (52) is separated from the first region (12), a conveyor means (24, 30, 28) for conveying cosmetic product from the first region (12) to the second region (52), a controllable valve (30, 34), the valve (30, 34) is open in a first operating condition of the conveyor means (24, 30, 28), and is closed in a second operating condition of the conveyor means (24, 30, 28), the conveyor means has a ring seal (30), wherein the ring seal (30) is displaceable and opens a vent opening (34) in the first operating condition and closes the vent opening (34) in the second operating condition.

2. A makeup device as set forth in claim 1, further including at least one feed passage means (50) for feeding cosmetic product from the first region (12) to the second region (52).

3. A makeup device as set forth in claim 1, wherein the conveyor means (24, 30, 28) includes means to reduce the pressure in the second region (52) relative to the pressure in the first region (12).

4. A makeup device as set forth in claim 1, wherein the conveyor means (24, 30, 28) is coupled to an applicator (20) for the cosmetic product.

5. A makeup device as set forth in claim 1, wherein the conveyor means (24, 30, 28) comprises a piston-cylinder unit.

6. A makeup device as set forth in claim 5, wherein the piston (30) is disposed in a handle portion (26) of an applicator (20).

7. A makeup device as set forth in claim 1, wherein the operating condition of the valve is pressure-dependent.

8. A makeup device as set forth in claim 7, wherein the valve opens when a threshold pressure is exceeded and closes when the pressure falls below the threshold pressure.

9. A makeup device as set forth in claim 1, further includes a receiving region (18), which is separated from the first region (12), for receiving the applicator (20) in a rest position.

10. A makeup device as set forth in claim 9, wherein the first region (12) surrounds the receiving region (18).

11. A makeup device as set forth in claim 9, wherein the second region (52) adjoins the receiving region (18) in such a way that the applicator (20) passes the second region (52) when it is removed from the receiving region (18).

12. A makeup device as set forth in claim 1, including a drag piston means (14, 16) for sealing off the first region (12) with respect to the environment.

13. A makeup device as set forth in claim 12, wherein the drag piston means (14, 16) has a closure mass (16).

14. A makeup device as set forth in claim 12, or claim 13 wherein the drag piston (14, 16) has an abutment disk (14).

15. A makeup device as set forth in claim 1, wherein the applicator (20) receives a cosmetic product.

16. A makeup device as set forth in claim 15, wherein the applicator is coupled at least to a part (24, 30) of a conveyor means (24, 30, 28) for the cosmetic product.

17. A makeup device as set forth in claim 16, wherein the applicator is coupled to a piston (30) of a piston-cylinder arrangement serving as the conveyor means (24, 30, 28).

18. A makeup device as set forth in claim 17, including a handle portion (26) within which the piston (30) is arranged.

* * * * *